US008850637B1

(12) United States Patent
Burchett

(10) Patent No.: US 8,850,637 B1
(45) Date of Patent: Oct. 7, 2014

(54) COUNTERBALANCING ASSEMBLY FOR FOLDING FURNITURE

(71) Applicant: C.A.B., Inc., Louisville, KY (US)

(72) Inventor: Dale D. Burchett, Louisville, KY (US)

(73) Assignee: C. A. B., Inc., Louisville, KY (US)

( * ) Notice: Subject to any disclaimer, the term of this patent is extended or adjusted under 35 U.S.C. 154(b) by 0 days.

(21) Appl. No.: 13/961,623

(22) Filed: Aug. 7, 2013

Related U.S. Application Data

(60) Provisional application No. 61/823,030, filed on May 14, 2013.

(51) Int. Cl.
*A47C 17/40* (2006.01)
*A47C 17/52* (2006.01)

(52) U.S. Cl.
CPC ..... *A47C 17/40* (2013.01); *A47C 17/52* (2013.01)
USPC ..... 5/136; 5/159.1; 5/164.1

(58) Field of Classification Search
CPC ..... A47C 17/38; A47C 17/40; A47C 17/48; A47C 17/52
USPC ..... 5/131, 133, 136, 159.1, 164.1, 166.1
See application file for complete search history.

(56) References Cited

U.S. PATENT DOCUMENTS 2,246,018 A * 6/1941 Snyder ..... 74/730.1
2,657,011 A * 10/1953 Slonneger ..... 254/270
4,337,670 A 7/1982 Carlson
5,033,134 A 7/1991 Burchett
5,446,932 A * 9/1995 Voorhis ..... 5/137
5,978,988 A 11/1999 Burchett
6,105,185 A * 8/2000 DiRocco ..... 5/164.1
8,006,327 B1 8/2011 Burchett
2013/0019399 A1 1/2013 Colombo

OTHER PUBLICATIONS

Wallbeds Northwest, "What is the Easy-Lift Wallbed Mechanism?" product information web page available at http://www.wallbedsnw.com/easy-lift.php (downloaded Sep. 9, 2013).
Wallbeds Northwest, "Why Choose the Easy-Lift Wallbed Mechanism?" product information web page available at http://www.wallbedsnw.com/why_easy-lift.php (downloaded Sep. 9, 2013).
Wallbeds Northwest, "Easy-Lift Wallbed Mechanism Specification," product information web page available at http://www.wallbedsnw.com/specs_easy-lift.php (downloaded Sep. 9, 2013).

(Continued)

*Primary Examiner* — Robert G Santos
(74) *Attorney, Agent, or Firm* — Stites & Harbison, PLLC; David W. Nagle, Jr.

(57) ABSTRACT

A counterbalancing assembly for an article of folding furniture comprises at least one piston extending between a support assembly and a furniture component, said piston being biased to resist a downward force of gravity acting on the furniture component. An upper mounting bracket secures a first end of the piston to the support assembly, and a lower mounting bracket secures a second end of the piston to the furniture component. One or both of the upper and lower mounting brackets includes a worm gear and a mounting element that is threaded onto the worm gear. Each such mounting element has a portion adapted to engage a complementary fitting defined by a respective end of the piston, such that rotation of the worm gear causes a corresponding linear movement of the mounting element, and thus, linear movement of the respective end of the piston.

11 Claims, 4 Drawing Sheets

(56) References Cited

OTHER PUBLICATIONS

Wallbeds Northwest, "About Us?", company information web page available at http://www.wallbedsnw.com/about_us.php (downloaded Sep. 9, 2013).

ISA/KR, International Search Report and Written Opinion issued in corresponding international application No. PCT/US2013/054146, mailed Jan. 28, 2014.

Wallbeds!, Assembly & Installation Instructions (undated).

* cited by examiner

COUNTERBALANCING ASSEMBLY FOR FOLDING FURNITURE

CROSS-REFERENCE TO RELATED APPLICATIONS

The present application claims priority to U.S. Provisional Patent Application Ser. No. 61/823,030 filed on May 14, 2013, the entire disclosure of which is incorporated herein by reference.

BACKGROUND OF THE INVENTION

The present invention relates to folding furniture and, more specifically, to a counterbalancing assembly for an article of folding furniture.

Various forms of folding furniture are well-known in the prior art and are commonly used where available space within the area of use is limited. Such folding furniture is provided with a rotation system that allows for the rotation of a frame supporting cushion/mattress components (which may collectively be referred to as a "user-contacting portion") or other furniture component (e.g., a table) between a storage position and a use position. Typically, the storage position is substantially upright (or vertical), and the user-contacting portion or other furniture component is housed in a decorative cabinet in this storage position. The use position is substantially horizontal, allowing the user to sit or lie on the cushion/mattress components held by the supporting frame, or allowing the user to otherwise use the furniture component. Because the combined weight of the elements that make up the user-contacting portion or other furniture component can be considerable, counterbalancing mechanisms are frequently employed that allow an individual to easily raise the user-contacting portion or other furniture component to the substantially upright storage position.

Various counterbalancing mechanisms have been developed for such folding furniture, including spring systems, counterbalancing hinges, and piston-based arrangements. Piston-based arrangements have proven to be especially effective in heavier applications, such as the counterbalancing of the weight of a wall bed, which includes the weight of the frame and the mattress (and possibly box springs). Examples of such piston-based arrangements are described in U.S. Pat. Nos. 5,033,134; 5,978,988; and 8,006,327, each of which is assigned to the assignee of the present application and is incorporated herein by reference. As described in U.S. Pat. Nos. 5,033,134; 5,978,988; and 8,006,327, two gas-filled counterbalance pistons, which provide an appropriate resistive force to the gravitational force acting on the frame and mattress, are secured to the inside surfaces of a wall-mounted cabinet (housing the frame and mattress in the substantially upright storage position) and to the sides of the frame. The pistons are biased to resist, i.e., counterbalance, the downward force of gravity acting on the frame and mattress, thus assisting in both the lowering of the frame and mattress to the use position and the lifting/returning of the frame and mattress to the substantially upright storage position.

U.S. Pat. No. 5,978,988 also describes the problem of variances in the weight of the user-contacting portion or other furniture component. To properly counterbalance the weight of the user-contacting portion or other furniture component, the pistons must be carefully selected, and the mounting locations for the piston ends must also be carefully selected. Variances in the weight complicate the selection of the pistons and the mounting locations. For example, with respect to a wall bed, the substitution of a particle board material for lighter board material for the frame is likely to require the use of heavier pistons with greater resistive counterbalancing force and/or change in the mounting locations. Such changes of the pistons and/or mounting locations can be both time-consuming and expensive, and may prove impractical to the end user who innocently changes the component weight.

U.S. Pat. No. 5,978,988 describes one solution to the problem of variances in the weight. Specifically, U.S. Pat. No. 5,978,988 describes a folding furniture apparatus with a counterbalancing system that creates one of a selected value of torques about a pivot axis to bias the user-contacting portion or other furniture component to the substantially upright storage position. The folding furniture apparatus thus includes at least one upper mounting bracket mounted to a support assembly (such as a wall-mounted cabinet) and a lower bracket mounted to the user-contacting portion or other furniture component, each of these brackets having a plurality of corresponding mounting points. The counterbalancing piston is pivotally secured to and extends from a selected mounting point on the lower bracket to an associated mounting point on the upper bracket. The lower mounting points and associated upper mounting points are preselected to provide the necessary counterbalancing (torque) for a certain weight of the user-contacting portion or other furniture component without requiring the use of a different piston or relocation of the mounting hardware. In other words, a user can move the piston and mount it to a different pair of mounting points to vary the counterbalancing torque that is applied to the user-contacting portion or other furniture component. However, this does require the disconnecting and reconnecting of each piston to the respective mounting brackets.

SUMMARY OF THE INVENTION

The present invention is a counterbalancing assembly for an article of folding furniture.

In an article of folding furniture, a furniture component can be rotated relative to a support assembly between a substantially upright storage position and a substantially horizontal use position about a pivot axis. A counterbalancing assembly then includes two gas-filled pistons secured to the inside surfaces of the support assembly and to the furniture component. The pistons are biased to resist the downward force of gravity acting on the furniture component and any supported cushion/mattress components, thus assisting in both the lowering of the furniture component and any supported cushion/mattress components to the use position and the lifting/returning of the furniture component and any supported cushion/mattress components to the substantially upright storage position The lower end and/or the upper end of each piston is fixed to a respective mounting bracket that allows for adjustment of the torque that biases the furniture component and any supported cushion/mattress components to the substantially upright storage position, but without requiring the use of a different piston, relocation of the mounting hardware, or even disconnecting and reconnecting the piston to the respective mounting brackets.

An exemplary upper mounting bracket is secured to the support assembly, such as the cabinet of a wall bed. The upper mounting bracket includes a channel mounted on the surface of the plate, which defines an internal cavity. A worm gear is received in this internal cavity and is mounted for rotation with respect to the channel. A mounting element is threaded onto the worm gear. The mounting element has a lower portion that includes a threaded hole therethrough for receiving the worm gear. The mounting element also includes an intermediate portion that fits through and engages a slot defined through the surface of the channel. Finally, the mounting element includes an upper ball portion that extends away from the channel and is adapted to engage a complementary ball-receiving opening or similar fitting defined by an end of one of the pistons. By rotating the worm gear, and as a result of the engagement of the intermediate portion of the mounting element with the slot defined through the surface of the channel, the mounting element is moved along the length of the slot.

An exemplary lower mounting bracket is secured to the furniture component, such as the frame of a wall bed. The lower mounting bracket includes a channel mounted on the surface of the plate, which defines an internal cavity. A worm gear is received in this internal cavity and is mounted for rotation with respect to the channel. A mounting element is threaded onto the worm gear. In this regard, the mounting element is the same as the one described above for use with the upper mounting bracket. Thus, in use, by rotating the worm gear, and as a result of the engagement of the intermediate portion of the mounting element with the slot defined through the surface of the channel, the mounting element is moved along the length of the slot.

As a result of the use of the upper mounting bracket and/or the lower mounting bracket, a user can readily adjust the torque that biases the furniture component to the substantially upright storage position, but without requiring the use of a different piston, relocation of the mounting hardware, or even disconnecting and reconnecting the piston to the respective mounting brackets.

DESCRIPTION OF THE INVENTION

The present invention is a counterbalancing assembly for an article of folding furniture.

Figure 1A:
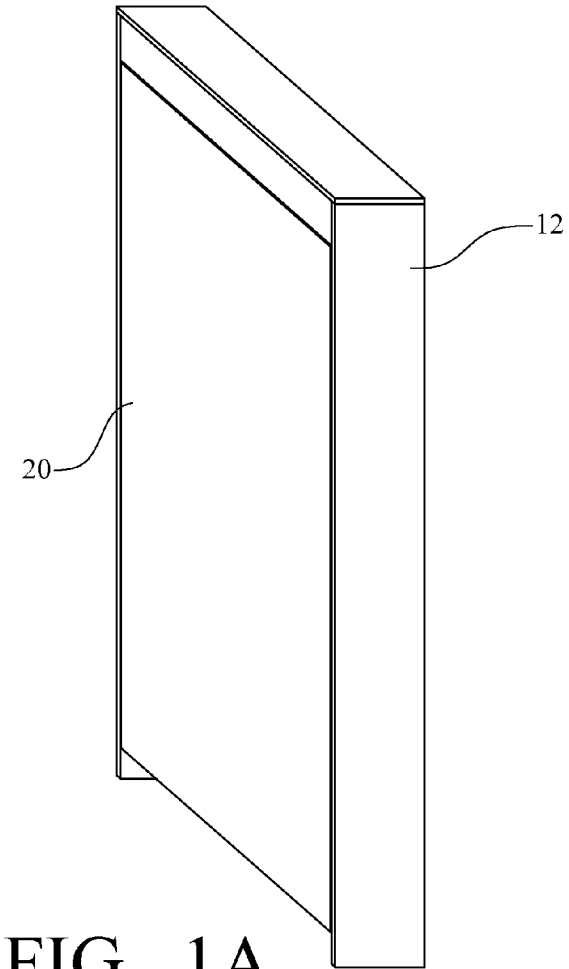
FIG. 1A is a perspective view of the exemplary article of folding furniture of FIG. 1, with the frame (or other furniture component) in a substantially upright storage position.
Figure 1:
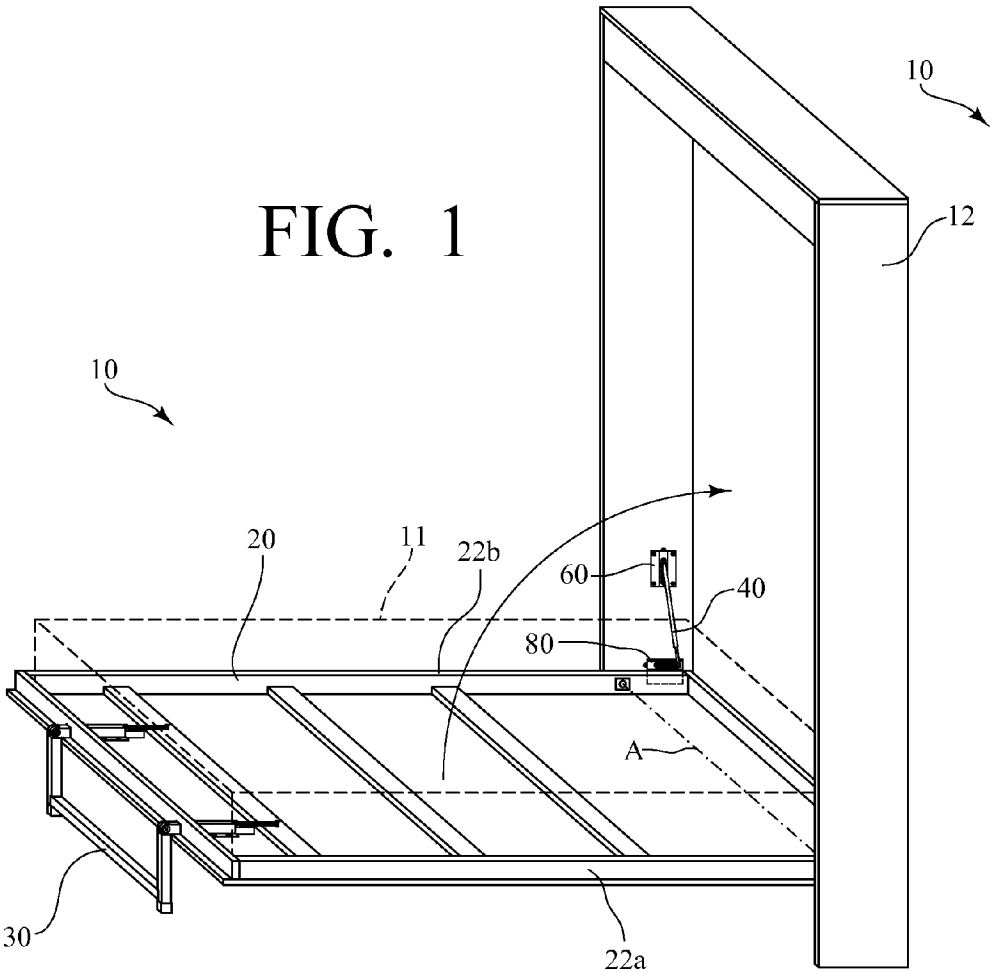
FIG. 1 is a perspective view of an article of folding furniture, with the frame (or other furniture component) in a substantially horizontal use position, which makes use of an exemplary counterbalancing assembly made in accordance with the present invention.

Referring now to FIGS. 1 and 1A, an article of folding furniture, such as a wall bed 10, has a furniture component that can be rotated between a substantially upright storage position and a substantially horizontal use position about a pivot axis (A). For instance, an exemplary wall bed 10 includes a frame 20 that is pivotally secured to a cabinet 12 (or similar support assembly). The frame 20 is adapted to support cushion/mattress components 11 (as shown in phantom). Also, while not critical to the present invention, in this exemplary embodiment, a pivoting leg assembly 30, similar to that described in U.S. Pat. No. 8,006,327, is operably connected to the frame 20 and provides support for the frame 20 when in the substantially horizontal use position.

The counterbalancing assembly then includes two gas-filled pistons (one of which is visible in FIG. 1 and labeled with reference numeral 40) secured to the inside surfaces of the cabinet 12 and to the side rails 22*a*, 22*b* of the frame 20, one on the left side and one on the right side. The pistons 40 are biased to resist the downward force of gravity acting on the frame 20 and any supported cushion/mattress components 11, thus assisting in both the lowering of the frame 20 and any supported cushion/mattress components 11 to the use position and the lifting/returning of the frame 20 and any supported cushion/mattress components 11 to the substantially upright storage position In accordance with the teachings of the present invention, however, the lower end and/or the upper end of each piston is fixed to a respective mounting bracket that allows for adjustment of the torque that biases the frame and any supported cushion/mattress components to the substantially upright storage position, but without requiring the use of a different piston, relocation of the mounting hardware, or even disconnecting and reconnecting the piston to the respective mounting brackets.

Figure 2:
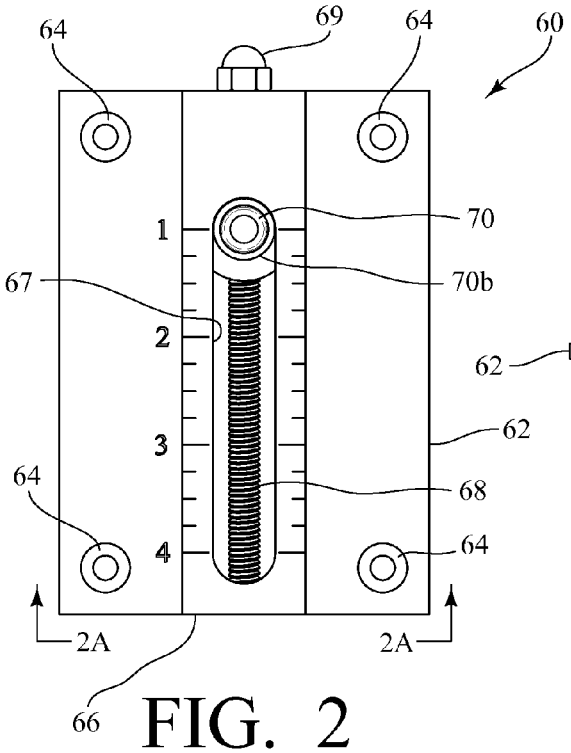
FIG. 2 is a plan view of one of the upper mounting brackets of the exemplary counterbalancing assembly of FIG. 1.
Figure 2A:
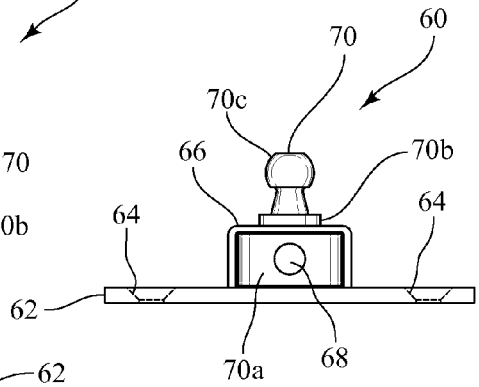
FIG. 2A is an end view of the upper mounting bracket of FIG. 2.

FIGS. 2 and 2A are views of an exemplary upper mounting bracket 60 made in accordance with the present invention. The upper mounting bracket 60 is secured to a support assembly, such as the wall-mounted cabinet 12 of the wall bed 10 in FIGS. 1 and 1A. As shown in FIGS. 2 and 2A, the upper mounting bracket 60 includes a plate 62 that defines one or more openings 64 therethrough, such that the plate 62 can be secured to the support assembly using screws or similar fasteners (not shown). The upper mounting bracket 60 further includes a channel 66 mounted on the surface of the plate 62, which defines an internal cavity. A worm gear 68 is received in this internal cavity and is mounted for rotation with respect to the channel 66.

Figure 4:
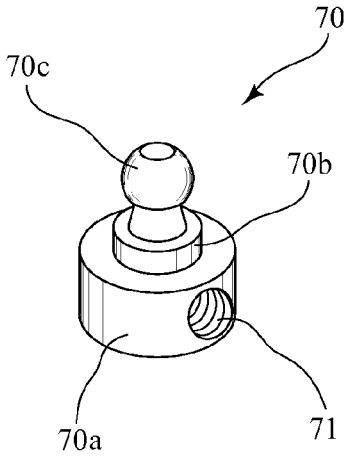
FIG. 4 is a perspective view of one of the mounting elements of the exemplary counterbalancing assembly of FIG. 1.
Figure 4A:
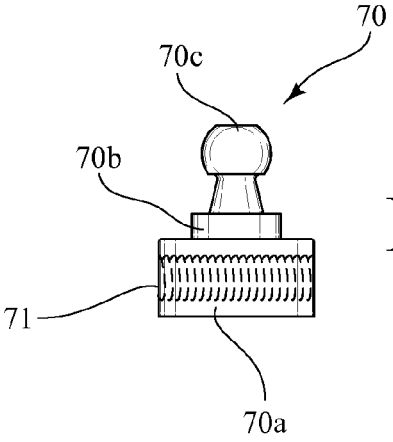
FIG. 4A is a side view of the mounting element of FIG. 4.
Figure 4B:
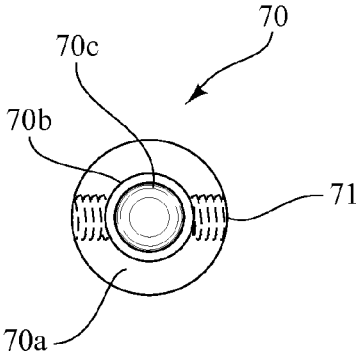
FIG. 4B is a top view of the mounting element of FIG. 4.

Referring still to FIGS. 2 and 2A, a mounting element 70 (which may also be referred to as a "ball stud") is threaded onto the worm gear 68. In this regard, and as shown in FIGS. 4, 4A, and 4B, the mounting element 70 has a lower portion 70*a* that includes a threaded hole 71 therethrough for receiving the worm gear 68. The mounting element 70 also includes an intermediate portion 70*b* that fits through and engages a slot 67 defined through the surface of the channel 66. Finally, and similar to the mounting arrangement described above with respect to U.S. Pat. No. 5,978,988, the mounting element 70 includes an upper ball portion 70*c* that extends away from the channel 66 and is adapted to engage a complementary ball-receiving opening or similar fitting (not shown) defined by an end of one of the pistons 40 (FIG. 1).

Referring again to FIGS. 2 and 2A, in use, by rotating the worm gear 68 (in this example, by rotating the nut 69), and as a result of the engagement of the intermediate portion 70*b* of the mounting element 70 with the slot 67 defined through the surface of the channel 66, the mounting element 70 is moved along the length of the slot 67.

Figure 3:
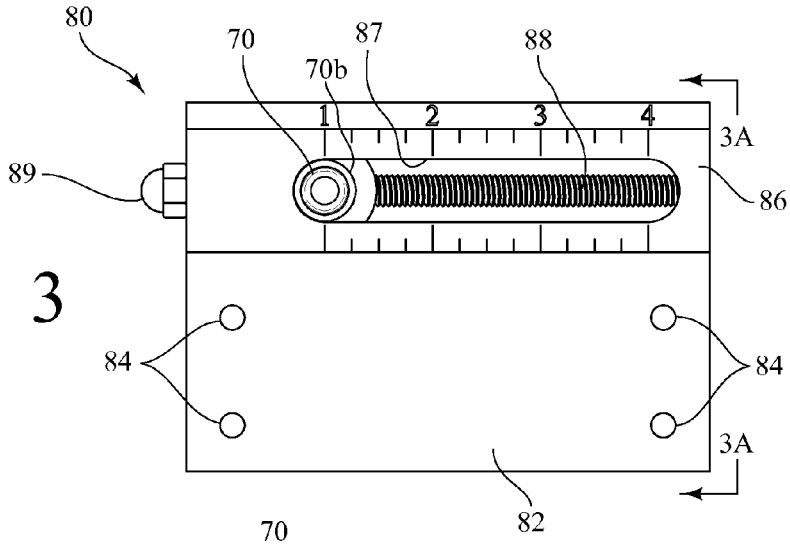
FIG. 3 is a plan view of one of the lower mounting brackets of the exemplary counterbalancing assembly of FIG. 1.
Figure 3A:
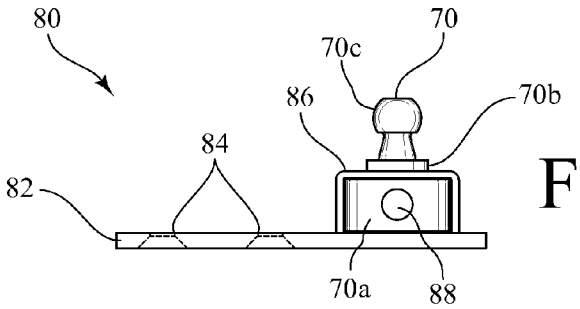
FIG. 3A is an end view of the lower mounting bracket of FIG. 3.

FIGS. 3 and 3A are views of an exemplary lower mounting bracket 80 made in accordance with the present invention. The lower mounting bracket 80 is secured to the furniture component that is pivotally secured to the support assembly, such as the frame 20 of the wall bed 10 in FIGS. 1 and 1A. As shown in FIGS. 3 and 3A, the lower mounting bracket 80 includes a plate 82 that defines one or more openings 84 therethrough, such that the plate 82 can be secured to the furniture component using screws or similar fasteners (not shown). The lower mounting bracket 80 further includes a channel 86 mounted on the surface of the plate 82, which defines an internal cavity. A worm gear 88 is received in this internal cavity and is mounted for rotation with respect to the channel 86.

Referring still to FIGS. 3 and 3A, a mounting element 70 is threaded onto the worm gear 88. In this regard, the mounting element 70 is the same as the one described above for use with the upper mounting bracket 60. Specifically, as shown in FIGS. 4 and 4A, the mounting element 70 has a lower portion 70*a* that includes a threaded hole therethrough for receiving the worm gear 88. The mounting element 70 also includes an intermediate portion 70*b* that fits through and engages a slot 87 defined through the surface of the channel 86. Finally, and similar to the mounting arrangement described above with respect to U.S. Pat. No. 5,978,988, the mounting element 70 includes an upper ball portion 70*c* that extends away from the channel 86 and is adapted to engage a complementary ball-receiving opening or similar fitting (not shown) defined by an end of one of the pistons 40 (FIG. 1).

Referring again to FIGS. 3 and 3A, in use, by rotating the worm gear 88 (in this example, by rotating the nut 89), and as a result of the engagement of the intermediate portion 70*b* of the mounting element 70 with the slot 87 defined through the surface of the channel 86, the mounting element 70 is moved along the length of the slot 87.

As a result of the use of the upper mounting bracket 60 and/or the lower mounting bracket 80, a user can readily adjust the torque that biases the frame 20 and any supported cushion/mattress components (or another furniture component) to the substantially upright storage position, but without requiring the use of a different piston, relocation of the mounting hardware, or even disconnecting and reconnecting the piston to the respective mounting brackets 60, 80.

Figure 5:
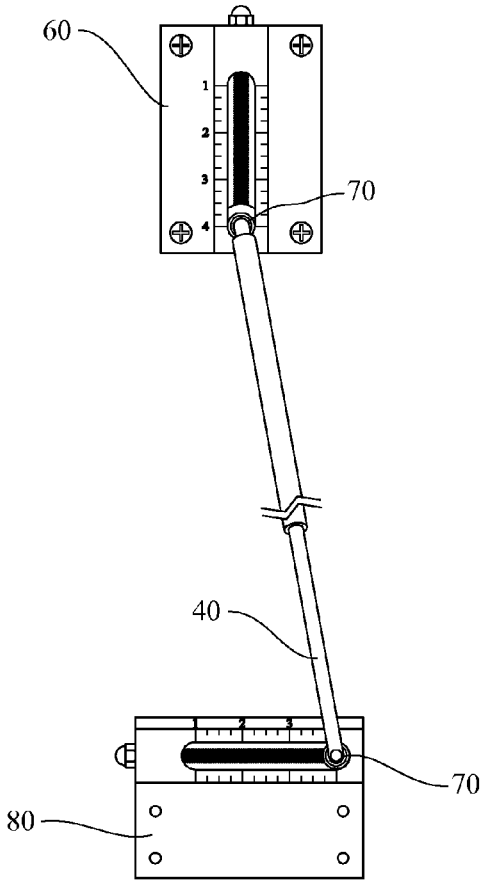
FIG. 5 is a view of the exemplary counterbalancing assembly of FIG. 1 that shows the mounting element associated with the lower mounting bracket in the rightmost position and the mounting element associated with the upper mounting bracket in the lowest position for maximum mechanical leverage.
Figure 6:
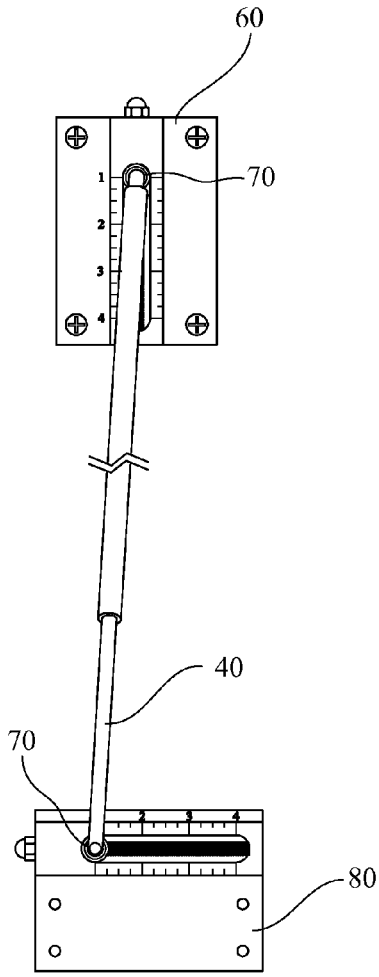
FIG. 6 is a view of the exemplary counterbalancing assembly of FIG. 1 that shows the mounting element associated with the lower mounting bracket in the leftmost position and the mounting element associated with the upper mounting bracket in the highest position for minimum mechanical leverage.

FIGS. 5 and 6 further illustrate the use of the counterbalancing assembly of the present invention and the adjustment of the torque that biases the frame 20 and any supported cushion/mattress components (or other furniture component) to the substantially upright storage position. As shown in FIG. 5, moving the mounting element 70 associated with the lower mounting bracket 80 away from the pivot axis (i.e., to the rightmost position), and moving the mounting element 70 associated with the upper mounting bracket 60 a corresponding distance (i.e., downward) to a lowest position results in a maximum mechanical leverage (i.e., highest torque value) for a given piston. On the other hand, as shown in FIG. 6, moving the mounting element 70 associated with the lower mounting bracket 80 closer to the pivot axis (i.e., to the leftmost position), and moving the mounting element 70 associated with the upper mounting bracket 60 a corresponding distance (i.e., upward) to a highest position results in a minimum mechanical leverage (i.e., lowest torque value) for a given piston. For example, the first position (FIG. 5) would be for a heavier furniture component, such as a king-size mattress, while the second position (FIG. 6) would be for a lighter furniture component, such as a twin-size mattress.

As also shown in FIGS. 5 and 6, as a further refinement, numbers or other indicia can be placed on the respective mounting brackets 60, 80 in order to provide a visual indication of the position of the mounting elements 70. For instance, such numbers or other indicia may indicate preferred positioning of the mounting elements 70 for various mattress sizes.

One of ordinary skill in the art will recognize that additional embodiments or implementations are possible without departing from the teachings of the present invention or the scope of the claims which follow. This detailed description, and particularly the specific details of the exemplary embodiments and implementations disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

The invention claimed is:

1. A counterbalancing assembly for an article of folding furniture which includes a furniture component that is pivotally secured to a support assembly for movement between a substantially upright storage position and a substantially horizontal use position, said counterbalancing assembly comprising:

at least one piston extending between the support assembly and the furniture component, said at least one piston being biased to resist a downward force of gravity acting on the furniture component;

an upper mounting bracket for securing a first end of the at least one piston to the support assembly, said upper mounting bracket including a worm gear and a mounting element that is threaded onto the worm gear, wherein the mounting element has a portion adapted to engage a complementary fitting defined by the first end of the at least one piston, and wherein rotation of the worm gear causes a corresponding linear movement of the mounting element, and thus, linear movement of the first end of the at least one piston relative to the support assembly; and a lower mounting bracket for securing a second end of the at least one piston to the furniture component.

2. The counterbalancing assembly as recited in claim 1, wherein the lower mounting bracket also includes a worm gear and a mounting element that is threaded onto the worm gear, wherein the mounting element has a portion adapted to engage a complementary fitting defined by the second end of the at least one piston, and wherein rotation of the worm gear causes a corresponding linear movement of the mounting element, and thus, linear movement of the second end of the at least one piston relative to the furniture component.

3. The counterbalancing assembly as recited in claim 1, wherein the mounting element associated with the upper mounting bracket further includes an intermediate portion that fits through and engages a slot defined through a surface of the upper mounting bracket, with the engagement of the intermediate portion of the mounting element with the slot defined through the surface of the upper mounting bracket resulting in the corresponding linear movement of the mounting element when the worm gear is rotated.

4. The counterbalancing assembly as recited in claim 2, wherein the mounting element associated with the lower mounting bracket further includes an intermediate portion that fits through and engages a slot defined through a surface of the lower mounting bracket, with the engagement of the intermediate portion of the mounting element with the slot defined through the surface of the lower mounting bracket resulting in the corresponding linear movement of the mounting element when the worm gear is rotated.

5. A counterbalancing assembly for an article of folding furniture which includes a furniture component that is pivotally secured to a support assembly for movement between a substantially upright storage position and a substantially horizontal use position, said counterbalancing assembly comprising:

at least one piston extending between the support assembly and the furniture component, said at least one piston being biased to resist a downward force of gravity acting on the furniture component;

an upper mounting bracket for securing a first end of the at least one piston to the support assembly;

a lower mounting bracket for securing a second end of the at least one piston to the furniture component, said lower mounting bracket including a worm gear and a mounting element that is threaded onto the worm gear, wherein the mounting element has a portion adapted to engage a complementary fitting defined by the second end of the at least one piston, and wherein rotation of the worm gear causes a corresponding linear movement of the mounting element, and thus, linear movement of the second end of the at least one piston relative to the furniture component.

6. The counterbalancing assembly as recited in claim 5, wherein the upper mounting bracket also includes a worm gear and a mounting element that is threaded onto the worm gear, wherein the mounting element has a portion adapted to engage a complementary fitting defined by the first end of the at least one piston, and wherein rotation of the worm gear causes a corresponding linear movement of the mounting element, and thus, linear movement of the first end of the at least one piston relative to the support assembly.

7. The counterbalancing assembly as recited in claim 5, wherein the mounting element associated with the lower mounting bracket further includes an intermediate portion that fits through and engages a slot defined through a surface of the lower mounting bracket, with the engagement of the intermediate portion of the mounting element with the slot defined through the surface of the lower mounting bracket resulting in the corresponding linear movement of the mounting element when the worm gear is rotated.

8. The counterbalancing assembly as recited in claim 6, wherein the mounting element associated with the upper mounting bracket further includes an intermediate portion that fits through and engages a slot defined through a surface of the upper mounting bracket, with the engagement of the intermediate portion of the mounting element with the slot defined through the surface of the upper mounting bracket resulting in the corresponding linear movement of the mounting element when the worm gear is rotated.

9. A wall bed, comprising:

a cabinet;

a frame that is pivotally secured to the cabinet for movement between a substantially upright storage position and a substantially horizontal use position; and a counterbalancing assembly, including at least one piston extending between the cabinet and the frame, said at least one piston being biased to resist a downward force of gravity acting on the frame, an upper mounting bracket for securing a first end of the at least one piston to the cabinet, said upper mounting bracket including a first worm gear and a first mounting element that is threaded onto the first worm gear, wherein the first mounting element has a portion adapted to engage a complementary fitting defined by the first end of the at least one piston, and wherein rotation of the first worm gear causes a corresponding linear movement of the first mounting element, and thus, linear movement of the first end of the at least one piston relative to the cabinet, and a lower mounting bracket for securing a second end of the at least one piston to the frame, said lower mounting bracket including a second worm gear and a second mounting element that is threaded onto the second worm gear, wherein the second mounting element has a portion adapted to engage a complementary fitting defined by the second end of the at least one piston, and wherein rotation of the second worm gear causes a corresponding linear movement of the second mounting element, and thus, linear movement of the second end of the at least one piston relative to the frame.

10. The counterbalancing assembly as recited in claim 9, wherein the first mounting element further includes an intermediate portion that fits through and engages a slot defined through a surface of the upper mounting bracket, with the engagement of the intermediate portion of the first mounting element with the slot defined through the surface of the upper mounting bracket resulting in the corresponding linear movement of the first mounting element when the first worm gear is rotated; and wherein the second mounting element further includes an intermediate portion that fits through and engages a slot defined through a surface of the lower mounting bracket, with the engagement of the intermediate portion of the second mounting element with the slot defined through the surface of the lower mounting bracket resulting in the corresponding linear movement of the second mounting element when the second worm gear is rotated.

11. A wall bed, comprising:

a cabinet;

a frame that is pivotally secured to the cabinet for movement between a substantially upright storage position and a substantially horizontal use position; and a counterbalancing assembly, including a left-side piston extending between the cabinet and the frame, said left-side piston being biased to resist a downward force of gravity acting on the frame, an upper mounting bracket for securing a first end of the left-side piston to the cabinet, said upper mounting bracket including a first worm gear and a first mounting element that is threaded onto the first worm gear, wherein the first mounting element has a portion adapted to engage a complementary fitting defined by the first end of the left-side piston, and wherein rotation of the first worm gear causes a corresponding linear movement of the first mounting element, and thus, linear movement of the first end of the left-side piston relative to the cabinet, a lower mounting bracket for securing a second end of the left-side piston to the frame, said lower mounting bracket including a second worm gear and a second mounting element that is threaded onto the second worm gear, wherein the second mounting element has a portion adapted to engage a complementary fitting defined by the second end of the left-side piston, and wherein rotation of the second worm gear causes a corresponding linear movement of the second mounting element, and thus, linear movement of the second end of the left-side piston relative to the frame, a right-side piston extending between the cabinet and the frame, said right-side piston being biased to resist the downward force of gravity acting on the frame, an upper mounting bracket for securing a first end of the right-side piston to the cabinet, said upper mounting bracket including a first worm gear and a first mounting element that is threaded onto the first worm gear, wherein the first mounting element has a portion adapted to engage a complementary fitting defined by the first end of the right-side piston, and wherein rotation of the first worm gear causes a corresponding linear movement of the first mounting element, and thus, linear movement of the first end of the right-side piston relative to the cabinet, and a lower mounting bracket for securing a second end of the right-side piston to the frame, said lower mounting bracket including a second worm gear and a second mounting element that is threaded onto the second worm gear, wherein the second mounting element has a portion adapted to engage a complementary fitting defined by the second end of the right-side piston, and wherein rotation of the second worm gear causes a corresponding linear movement of the second mounting element, and thus, linear movement of the second end of the right-side piston relative to the frame.

* * * * *